US005121855A

United States Patent [19]

Credle, Jr.

[11] Patent Number: 5,121,855

[45] Date of Patent: Jun. 16, 1992

[54] BEVERAGE DISPENSER SYSTEM USING VOLUMETRIC RATIO CONTROL DEVICE

[75] Inventor: William S. Credle, Jr., Stone Mountain, Ga.

[73] Assignee: The Coca-Cola Company, Atlanta, Ga.

[21] Appl. No.: 783,478

[22] Filed: Oct. 28, 1991

Related U.S. Application Data

[63] Continuation-in-part of Ser. No. 432,639, Nov. 7, 1989, Pat. No. 5,060,824, which is a continuation-in-part of Ser. No. 264,424, Oct. 31, 1988, abandoned, which is a continuation of Ser. No. 888,546, Jul. 18, 1986, abandoned.

[51] Int. Cl.[5] ..... B67D 5/56

[52] U.S. Cl. ..... 222/129.2; 137/99; 222/136; 222/249

[58] Field of Search ..... 222/129.1, 129.2, 129.3, 222/129.4, 135-137, 145, 249, 250, 334; 137/99

[56] References Cited

U.S. PATENT DOCUMENTS

| | | | |
|---|---|---|---|
| 2,736,466 | 2/1956 | Rodth | 222/129.2 X |
| 3,591,051 | 7/1971 | Mitchell | 222/249 X |
| 3,830,405 | 8/1974 | Jaeger | 222/129.3 |
| 4,966,306 | 10/1990 | Credle, Jr. et al. | 222/129.2 X |
| 5,060,824 | 10/1991 | Credle, Jr. | 222/129.2 X |

*Primary Examiner*—Kevin P. Shaver
*Attorney, Agent, or Firm*—Thomas R. Boston; W. Dexter Brooks

[57] ABSTRACT

A post-mix dispensing valve for a beverage dispenser, including a self-contained volumetric ratio control device incorporated therein to provide positive ratio control. The device includes a single piston in a single cylinder, syrup and soda chambers, and self-contained direct acting electrical solenoid valve means for controlling the flow through the volumetric ratio control device and the reciprocating action of the piston. The soda pressure drives the piston. This post-mix dispensing valve can be used with any of a figal, a bag-in-box, a gravity tank, or a non-returnable container under no pressure or under a low pressure of 5 to 10 psig. This invention also includes a non-returnable, pressurizable syrup container.

4 Claims, 17 Drawing Sheets

BEVERAGE DISPENSER SYSTEM USING VOLUMETRIC RATIO CONTROL DEVICE

CROSS-REFERENCE TO RELATED APPLICATIONS

This application is a continuation-in-part of U.S. patent application Ser. No. 07/432,639, filed Nov. 7, 1989 and having the same title, inventor and assignee as the present application, now U.S. Pat. No. 5,060,824, which is a continuation-in-part of U.S. patent application Ser. No. 07/264,424 filed Oct. 31, 1988 and having the same title, inventor and assignee as the present application, now abandoned, which parent application is in turn a continuation of U.S. patent application Ser. No. 06/888,546, now abandoned, filed Jul. 18, 1986 and having the same inventor, title and assignee as the present application.

BACKGROUND OF THE INVENTION

1. Field of the Invention

This invention relates to post-mix beverage dispensers and to post-mix dispensing valves for mixing together and dispensing a controlled ratio of syrup and carbonated water; more particularly, this invention concerns a post-mix dispensing valve including inside of the dispensing valve itself a self-contained, double-acting piston-cylinder volumetric ratio control device with a direct acting electrical solenoid control valve means.

2. Description of the Prior Art

Known post-mix dispensing valves (alternatively known in the art as dispensing heads or faucets) control syrup and soda (carbonated water) flow with two mechanical flow controls that are adjusted independently of each other to achieve proper mixture ratio. If either flow control malfunctions or changes, the ratio will change because one flow control cannot compensate for the variations of the other. The mechanical flow controls, which require high flowing pressures (about 50 psig) to function properly, do not compensate for viscosity changes caused by temperature fluctuations. New electrical flow control valves including sensors and microprocessors are being developed to overcome these problems, however, they are relatively complicated and expensive.

U.S. Pat. No. 2,427,429 to Waite shows a coin operated cup dispenser using a double-acting piston-cylinder unit which is very large and complex and requires a complex and large electrical-hydraulic pilot operating mechanism to turn a rotary valve containing eight ports. Waite has two separate pistons in two separate cylinders and has a relatively large residual storage capacity. U.S. Pat. No. 2,736,466 to Rodth shows a liquid metering and dispensing device that has an electrical-mechanical pilot operating mechanism with a cam actuator which in turn operates four double-acting valves. Rodth's device is not self-contained inside of a post-mix dispensing valve, and his water chamber has a volume that is not emptied at each stroke. Rodth employs check valves in his syrup line; thus, he cannot use a pressurized syrup source because the syrup would just "blow-through" the check valves.

SUMMARY OF THE INVENTION

This invention provides a relatively simple, inexpensive, post-mix dispensing valve that provides positive ratio control. This post-mix dispensing valve volumetrically controls the amount of syrup and soda that are mixed together. The dispensing valve includes a self-contained volumetric ratio control device (VRCD) with a self-contained direct acting electrical solenoid valve control means and includes syrup and soda pistons connected together, associated syrup and soda chambers, and valves for controlling the flow to and from the chambers. The VRCD of this invention provides an improvement over known dispensing valves because it does not require high flowing pressures and because the pistons allow one liquid flow to compensate for fluctuations in the other liquid flow. The VRCD of this invention is simpler and less expensive than the new electrical ratio control valves because it is not concerned with (and does not measure) temperatures, viscosities, syrup characteristics or Reynolds numbers, for example. The VRCD is only concerned with repeatedly filling volumetric measuring chambers and then emptying the chambers into a mixing nozzle.

Another advantage of this VRCD is that it can work with a variety of different post-mix syrup packages. Present pressurized post-mix dispensers require a source of pressurized syrup to operate correctly. This syrup can come from a pressurized figal or from a syrup pump that is connected to a bag-in-box package. However, it is difficult with the present equipment to readily convert from one type of package to another. The VRCD of this invention overcomes this shortcoming because it can work as a pressurized valve or as a valve/pump combination. When operated as a pressure valve, it can function properly with high pressure syrup or with low pressure syrup. When operated as a valve/pump combination, it can empty the contents of a bag-in-box package, a vented package, or a very low pressure syrup package, without the use of a syrup pump. The VRCD also works with a gravity dispenser and will provide better ratio control than the gravity dispenser valves presently being used. To summarize, the VRCD will work with either a gravity dispenser or a pressurized dispenser. It will work with pressurized containers (figals) or non-pressurized containers (bag-in-box, syrup containers, etc.). Because the VRCD in this invention works with syrups at no pressure and at low pressures, the present invention also includes inexpensive, non-returnable, syrup containers including one that can operate at no pressure and ones that can be pressurized up to about 5 to 10 psig. Such low pressure containers could not previously have been used because of the high pressures required to make the known pressurized dispensing valves operate properly. It is also important to note that the VRCD of this invention can work with all of these different types of dispensers and syrup packages, and it can do so without making any adjustments to the dispensing valve, and without adding any auxiliary equipment (such as a syrup pump) to the valve or dispenser.

The post-mix dispensing valve of this invention includes a body and a nozzle connected to the body. The dispensing valve includes a self-contained VRCD and a direct-acting valve control means. The term "self-contained" means and is hereby defined to mean for purposes of this application that the VRCD and valve control means are located inside of the body of the post-mix dispensing valve itself. The term "direct acting" means that there is no separate, intermediate, additional pilot operating mechanism. Further, the syrup piston is of uniform diameter rather than having the syrup piston connected by a stem to the water piston. This helps solve the casual drink problem because it eliminates the volume of water that would otherwise remain in the water chamber.

It is an object of the present invention to provide a simple, inexpensive, post-mix dispensing valve that can provide positive ratio control.

It is another object of the present invention to provide a beverage dispenser and a beverage dispenser valve that work with a variety of different post-mix syrup packages and that do so without making any adjustments to the valve or adding any auxiliary equipment to the valve or to the dispenser.

It is another object of the present invention to provide a beverage dispenser and a beverage dispenser valve that can readily convert from one type of syrup package to another.

It is another object of the present invention to provide a dispensing valve for a beverage dispenser that can operate as a valve/pump combination that can empty the contents of a bag-in-box package or a non-returnable, low pressure or no pressure syrup package, without the use of a syrup pump.

It is another object of the present invention to provide a beverage dispensing method using a dispensing valve incorporating a volumetric ratio control device for dispensing from a non-pressurizable, collapsible concentrate container without the use of a syrup pump.

It is another object of the present invention to provide a dispensing valve for a beverage dispenser incorporating therein a volumetric ratio control device.

It is a further object of the present invention to provide a beverage dispensing system including a beverage dispenser, a dispensing valve, and a non-returnable, rigid, pressurizable syrup container pressurized to about 5–10 psig.

It is another object of the present invention to provide a non-returnable, pressurizable syrup container for use with beverage dispensers and having sufficient strength to safely hold syrup under pressure no greater than about 5–10 psig.

It is another object of the present invention to provide a post-mix dispensing valve including a self-contained VRCD and valve control means.

It is a further object of the present invention to provide a post-mix dispensing valve with a VRCD including a direct acting electrical solenoid valve control means.

It is another object of the present invention to provide a post-mix dispensing valve including a self-contained VRCD with a piston-cylinder unit including a single piston having a water piston portion and a syrup piston portion in which the syrup piston portion has a uniform diameter to help solve the casual drink problem by eliminating a volume of water that would otherwise remain in the water chamber. An acceptable cool drink is one whose temperature is below 40° F.

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENTS

Figure 14:
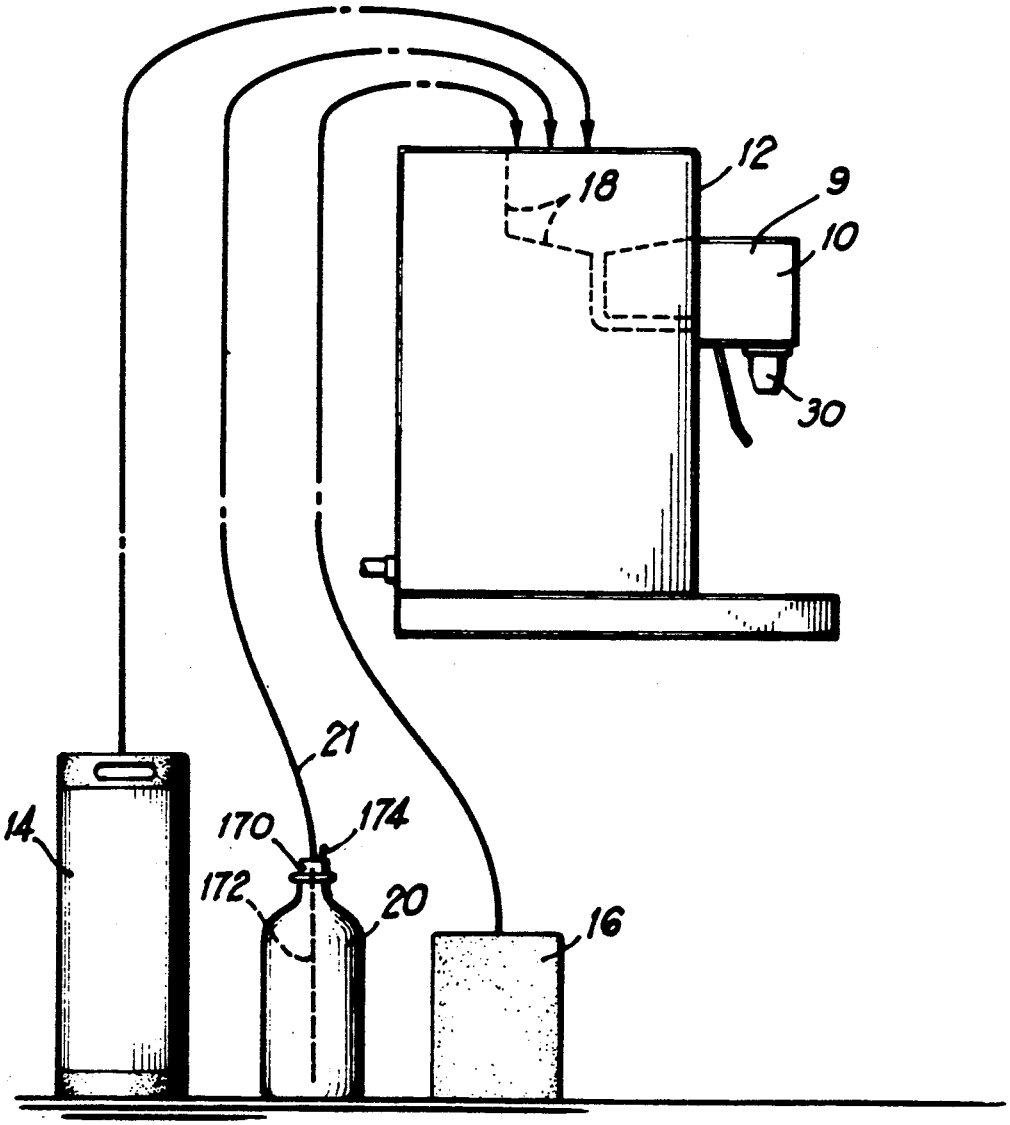
FIG. 14 is a diagrammatic view of a beverage dispenser including a dispensing valve according to the present invention, and showing the four different types of syrup containers useful therewith.

With reference now to the drawings, FIGS. 1–5 show a dispensing valve 10 according to one embodiment of the present invention. The dispensing valve 10 can be mounted on a beverage dispenser 12 as shown in FIG. 14. Any one of a number of the dispensing valves 10 such as four, five or six, for example, can be mounted on the beverage dispenser 12. The syrup source can be a figal 14, a bag-in-box 16, a gravity tank 18 built directly into the beverage dispenser 12, or a non-returnable container 20 according to the present invention and described in more detail hereinafter.

Returning now to the dispensing valve 10 of FIGS. 1–5, the dispensing valve consists of a body 22 and a nozzle 30 connected to the body. The body 22 includes separate soda and syrup passageways 24 and 26, respectively, therethrough, and a volumetric ratio control device (VRCD) 32 in said body for controlling the ratio of soda to syrup in the beverage dispensed from the valve 10, with valve means 28 for controlling the flow through the passageways 24 and 26. The valve 10 can include a cover 91 (see FIG. 14), if desired. The nozzle 30 provides for mixing together the soda and syrup and for dispensing the mixture therefrom.

The VRCD 32 includes a syrup piston 40, a soda piston 42 connected to the syrup piston 40, a pair of syrup chambers 44 and 46, a pair of soda chambers 48 and 50, two four-way valves 52 and 54, and two solenoids 56 and 58. The soda passageway 24 includes a passageway to each of the soda chambers 48 and 50, and the syrup passageway 26 includes a syrup passageway to each of the syrup chambers 44 and 46. The VRCD thus includes a single piston in a single cylinder, with the cylinder having central larger diameter water portion and two smaller diameter concentrate portions on each side of the water portion. The piston has a corresponding central larger diameter water piston portion and two smaller diameter concentrate piston portions, one on each side of the water piston portion. Each of the concentrate piston portions is cylindrical and has a uniform diameter along its entire length for displacing water for providing improved casual drink performance.

Figure 1:
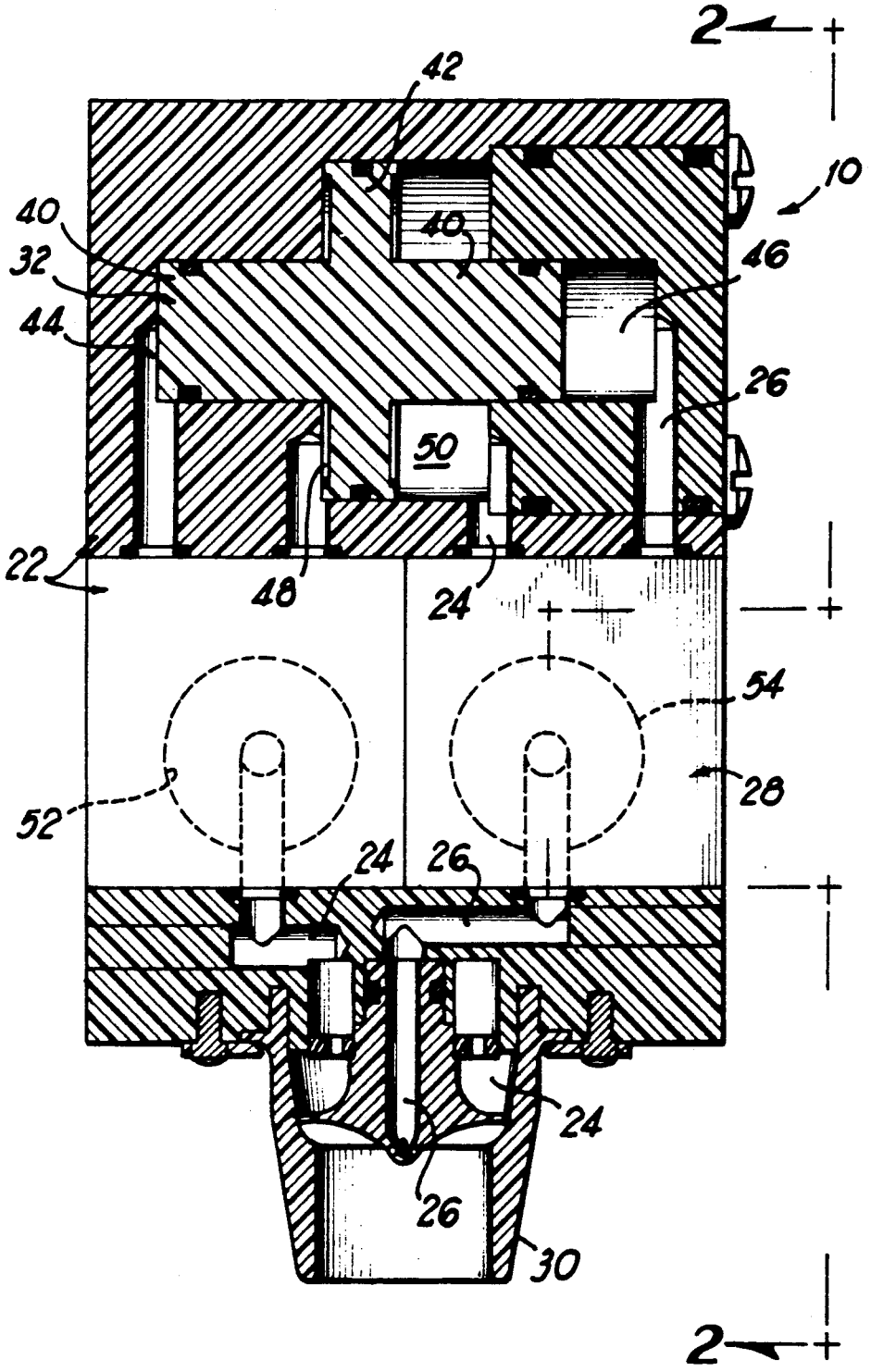
FIG. 1 is a partly cross-sectional end view through a dispensing valve according to one embodiment of the present invention.
Figure 2:
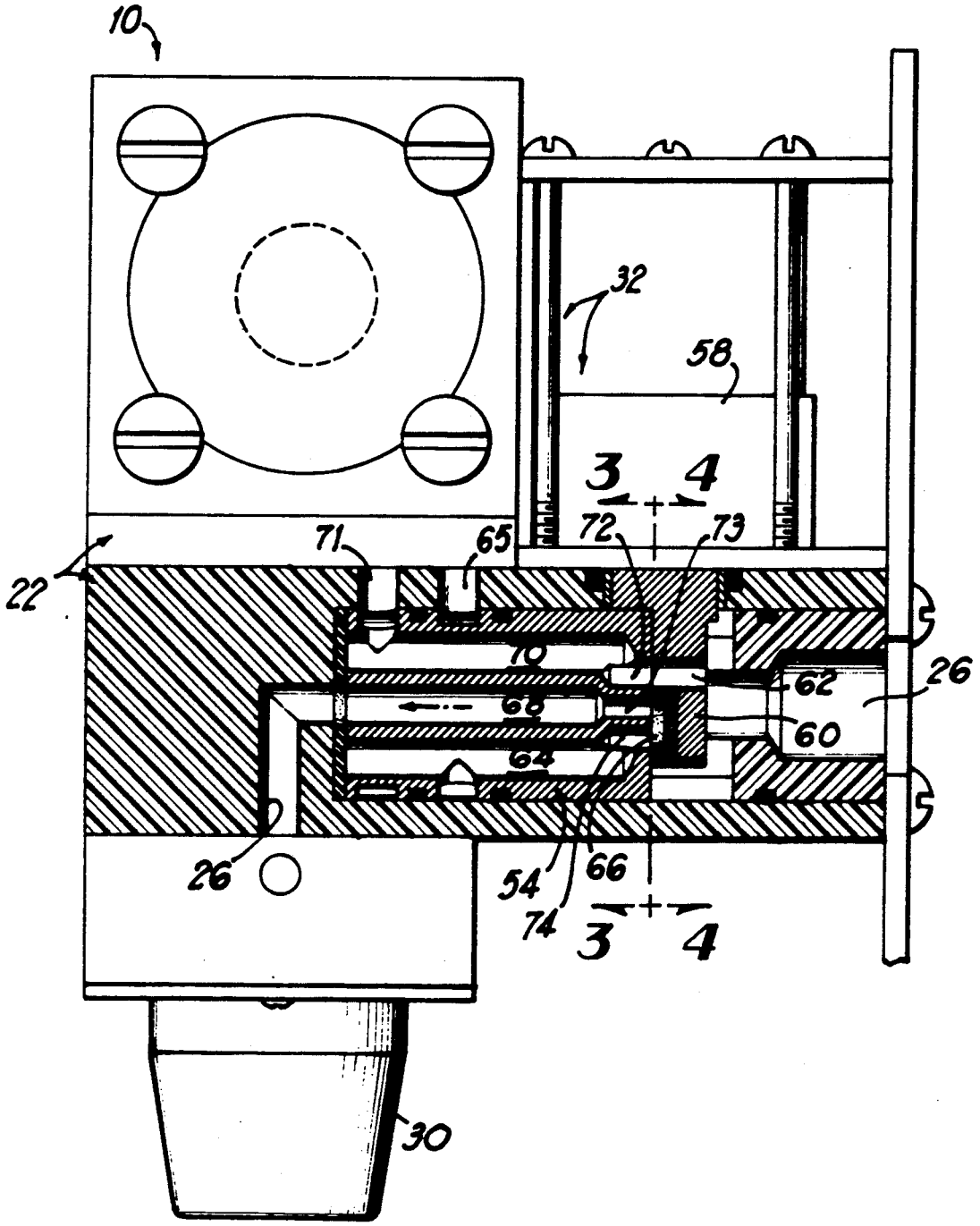
FIG. 2 is a partly cross-sectional side view through the valve of FIG. 1 taken along line 2—2 thereof.

The valve means for controlling the flow through the passageways includes the solenoids 56 and 58, one of which (58) is shown in FIG. 2 controlling an armature 60 in the syrup passageway 26. When the armature is in the position shown in FIG. 2 (for example, with the solenoid 58 not energized), the syrup can flow through syrup inlet passageway 26, through a port 62 in the armature 60, through passageways 70 and 71, one of the syrup chambers 44 or 46, while at the same time syrup is flowing from the other of the chambers 44 or 46 through the passageway 64, then through the groove 66, and then into passageway 68 where it flows down into the nozzle 30 as shown in FIG. 2. When the syrup piston 40 reaches the end of its stroke, the solenoid 58 is energized to retract the armature 60 to provide communication between the inlet passageway 26 and the other syrup chamber through the passageways 64 and 65, while syrup is forced out of the other syrup chamber into the nozzle through passageway 71, then passageway 70, through groove 66 and then through passageway 68 to the nozzle 30. The same operation occurs on the other side of the dispensing valve with respect to the soda (or carbonated water).

Figure 3:
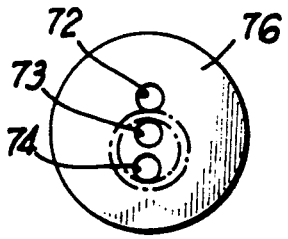
FIG. 3 is an elevational view taken along line 3—3 of FIG. 2.
Figure 4:
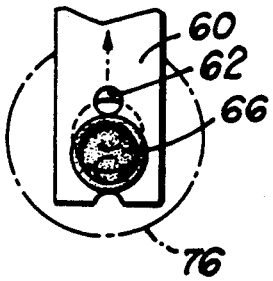
FIG. 4 is an elevational view taken along line 4—4 of FIG. 2.

FIG. 3 shows the three ports 72, 73 and 74 providing communication with the passageways 70, 68 and 64, respectively, in a central member 76. FIG. 4 shows the port 62 and the groove 68 in the armature 60 of the solenoid 58.

Figure 5:
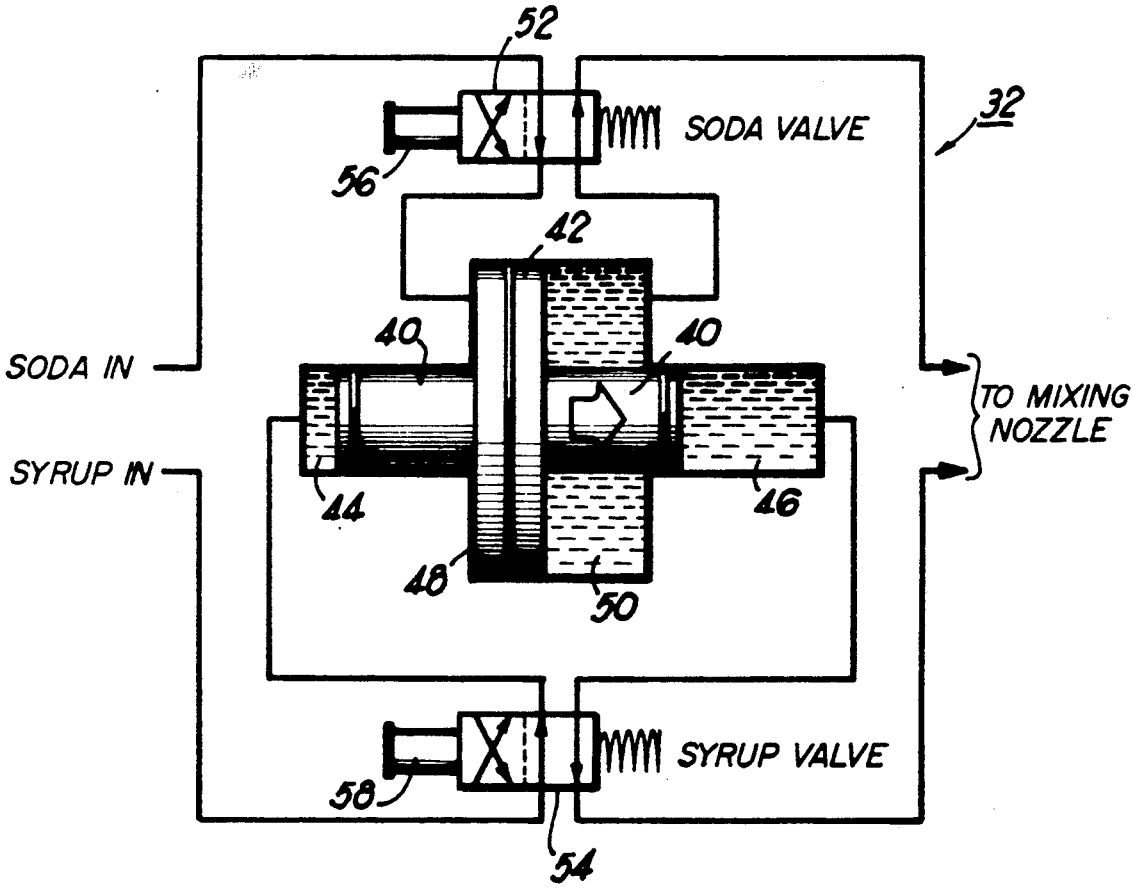
FIG. 5 is a schematic view of the embodiment shown in FIGS. 1 to 4.

The solenoids 56 and 58 and the valves 52 and 54 direct syrup and soda to the left side of the pistons as shown in FIG. 5, while the pistons move from left to right causing the liquids on the right side of the pistons to be expelled into the mixing nozzle. When the pistons reach the right-hand end of their travel, the solenoids are energized to activate the valves and thus reverse the flow and cause the liquids on the left side of the pistons to be directed to the mixing nozzle. In a properly sized valve, the pistons will preferably change directions several times each second. In order to change ratio in this type of valve, the pistons/chamber assembly must be replaced with a different sized assembly.

An advantage of placing the VRCD directly in the dispensing valve is to reduce the number of water lines that would be required if the VRCD were placed, for example, upstream of the refrigeration system and the soda and syrup lines were kept separate up to the valve.

Figure 6:
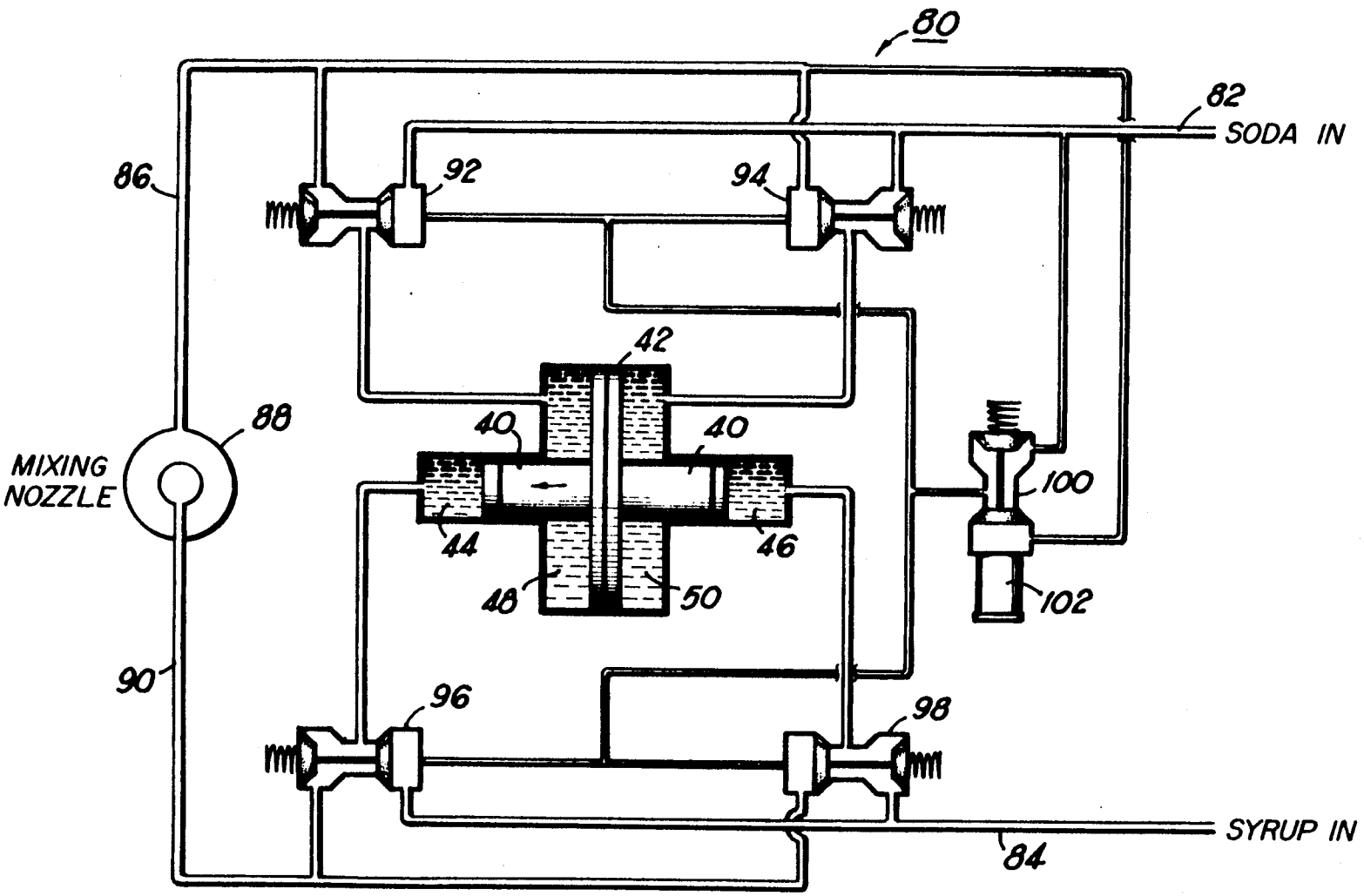
FIG. 6 is a diagrammatic view of another embodiment of the present invention.
Figure 7:
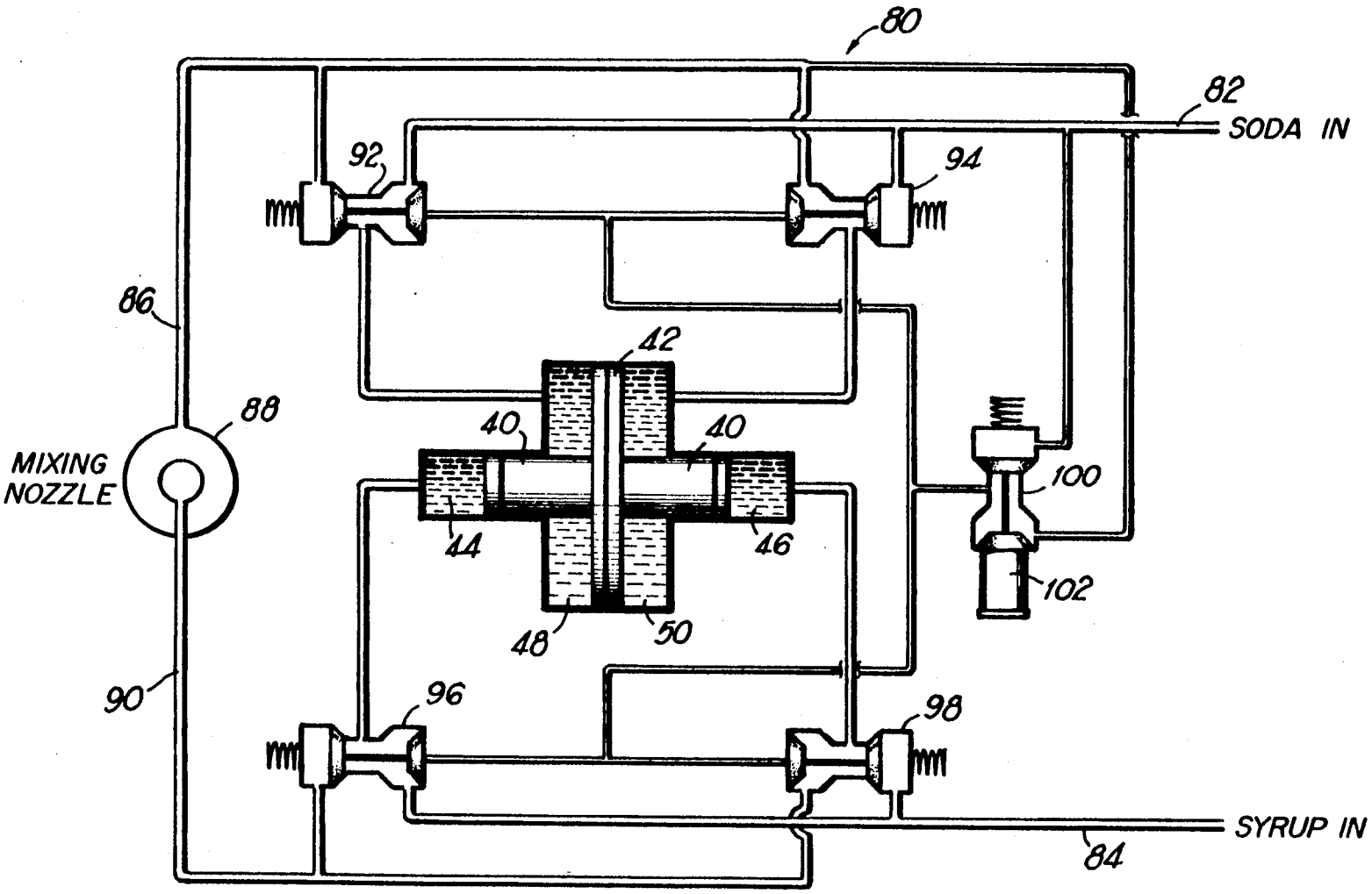
FIG. 7 is a diagrammatic view similar to FIG. 6 but showing the valves in the opposite position to that shown in FIG. 6.

Reference will now be made to FIGS. 6 and 7 which show another embodiment of the VRCD of the present invention, and in particular one using four three-way valves rather than the two four-way valves used in the embodiments of FIGS. 1-5.

FIGS. 6 and 7 show a volumetric ratio control device 80 that can be used in a dispensing valve such as the valve 10 of FIGS. 1-5. FIGS. 6 and 7 diagrammatically show the syrup piston 40, the soda piston 42, syrup chambers 44 and 46, and the soda chambers 48 and 50. The volumetric ratio control device 80 includes a soda-in conduit 82, a syrup-in conduit 84, a soda-out conduit 86 to a mixing nozzle 88, and a syrup-out conduit 90 to the mixing nozzle 88. The volumetric ratio control device 80 includes valve means for controlling the flow in the soda and syrup passageways including four three-way pilot-actuated poppet valves 92, 94, 96 and 98 controlled by a single solenoid-actuated pilot valve 100. The valve 100 is actuated by a solenoid 102. The solenoid-actuated pilot valve 100 uses pressurized soda as the pilot fluid.

FIG. 6 shows the solenoid 102 in its energized condition such that the valve 100 is open to provide pressurized soda communication to the four three-way poppet valves 92, 94, 96 and 98 to position these valves in their orientation shown in FIG. 6 with the pistons 40 and 42 moving to the left as shown in FIG. 6. At the end of the stroke of the piston to the left as shown in FIG. 6, the solenoid 102 is de-energized allowing a spring to move the pilot valve to its position shown in FIG. 7. At this time the soda line to the four three-way poppet valves is vented by the pilot valve 100 which causes the four three-way valves 92, 94, 96 and 98 to move to their position shown in FIG. 7 for use when the pistons 40 and 42 are moving to the right (as shown in FIG. 7), at which time the syrup and soda flow into the leftmost chambers and are forced by the pistons out of the rightmost chambers to the mixing nozzle. This embodiment with the four three-way poppet valves is presently the preferred embodiment.

Figure 8:
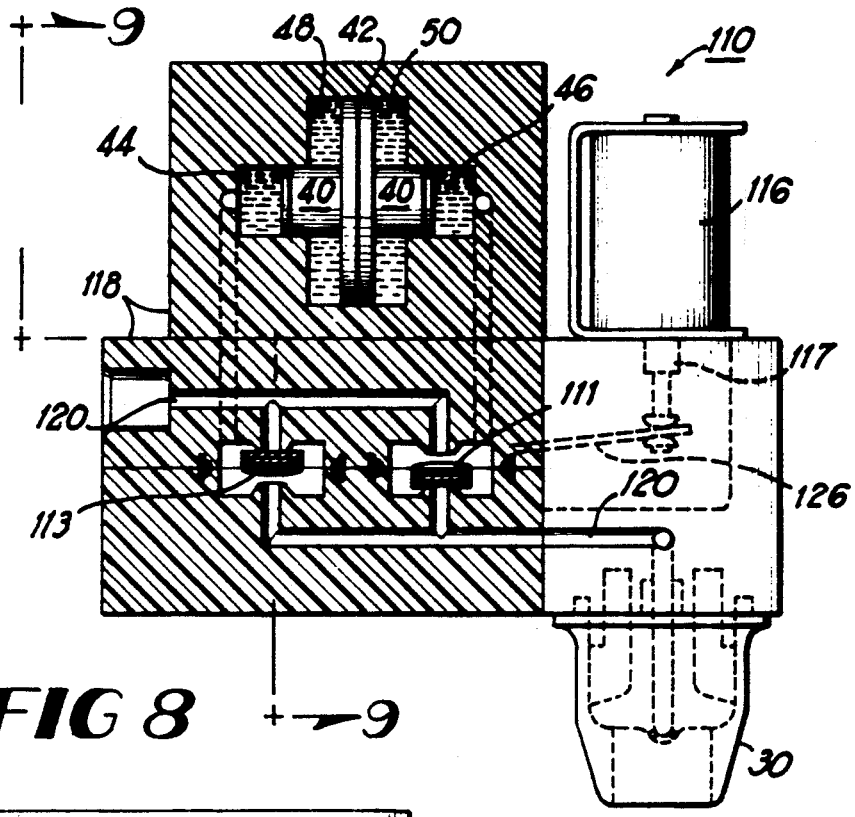
FIG. 8 is a partly cross-sectional side view of a dispensing valve according to another embodiment of the present invention.
Figure 9:
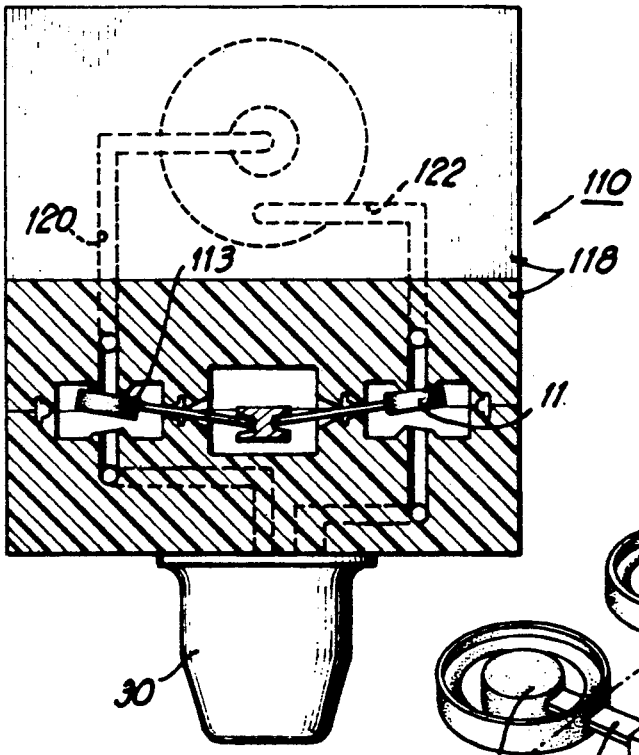
FIG. 9 is a partly cross-sectional end view of the valve of FIG. 8 taken along line 9—9 of FIG. 8.
Figure 10:
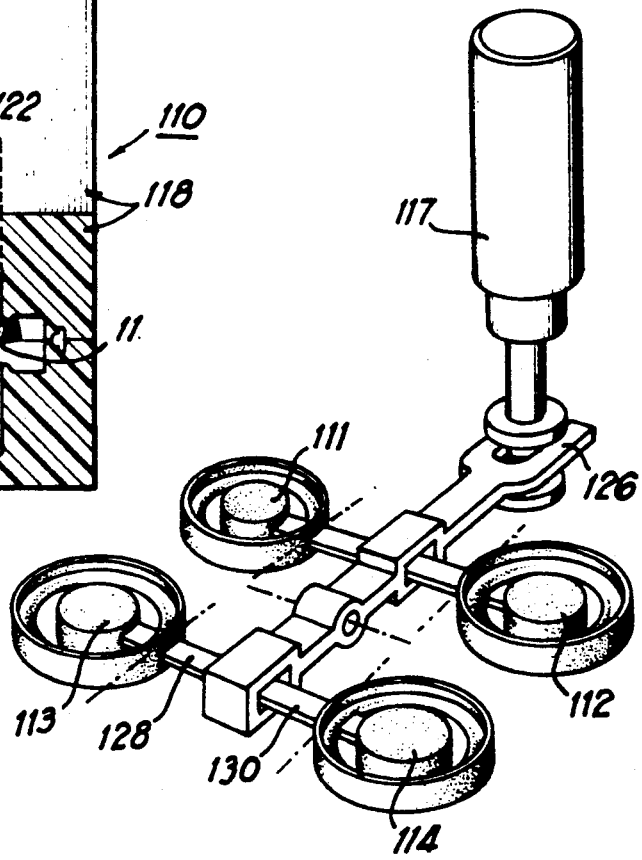
FIG. 10 is a perspective view of the paddle valves used in the embodiment shown in FIGS. 8 and 9.

FIGS. 8 to 10 show a dispensing valve 110 according to another embodiment of the present invention which uses four three-way paddle valves 111, 112, 113 and 114 which are mechanically actuated by a single solenoid 116 having an armature 117. The valves 111 and 113 are syrup valves, and valves 112 and 114 are soda valves. The cross-section in FIG. 8 is taken through the syrup valves 111 and 113. The cross-section in FIG. 9 is taken through the valves 113 and 114.

The dispensing valve 110 includes the syrup piston 40, the soda piston 42, syrup chambers 44 and 46, soda chambers 48 and 50, and the nozzle 30. The dispensing valve 110 includes a body 118 having a syrup passageway 120 and a soda passageway 122 therethrough. The solenoid 116 includes a spring (not shown) for forcing the armature 117 downwardly (as viewed in FIG. 8). When the solenoid is energized it pulls the armature 117 upwardly. FIG. 8 shows the pistons 40 and 42 moving to the left, the paddle valves 113 and 114 being opened by the solenoid 116 being energized to pull upon a lever arm 126 (as viewed in FIG. 10), thus pushing down on the actuating arms 128 and 130 of the paddle valves 113 and 114 thus causing them to open. At the same time, the paddle valves 111 and 112 are caused to close. The soda and syrup flows through the soda and syrup passageways into the rightmost chambers 50 and 46 filling those chambers, and the soda and syrup is at the same time forced out of the leftmost chambers to the nozzle 30. At the end of the stroke of the pistons 40 and 42 to the left (as viewed in FIG. 8), the solenoid 116 is de-energized, whereby the solenoid spring (not shown) forces the lever arm 126 down, reversing the above described liquid flow.

Figure 11:
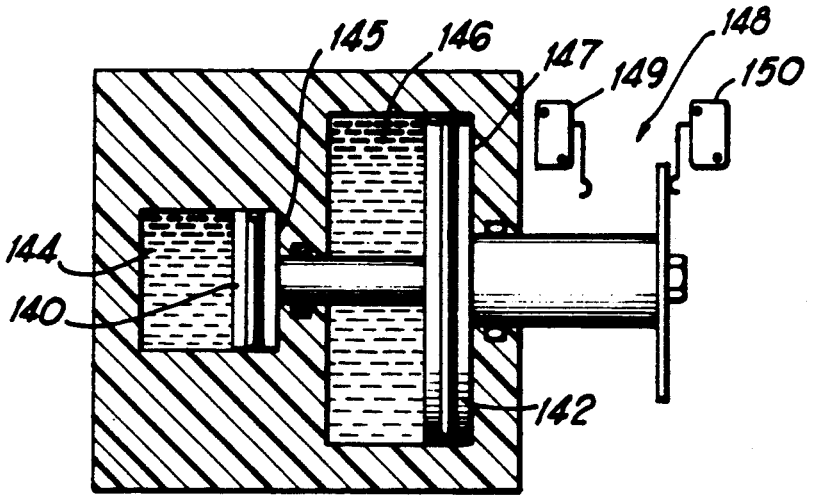
FIG. 11 is a partly diagrammatic, partly schematic view of a volumetric ratio control device showing an electrical switch means associated therewith.

FIG. 11 is a diagrammatic and schematic showing of a syrup piston 140, a soda piston 142, syrup chambers 144 and 145, and soda chambers 146 and 147. FIG. 11 also shows electrical circuit contact means 148 for detecting when the pistons 140 and 142 have reached the end of their stroke. The electrical contact means 148 can use microswitches 149 and 150 for energizing the solenoid means of the various valve means shown in the drawings of the previously described embodiments.

Figure 12:
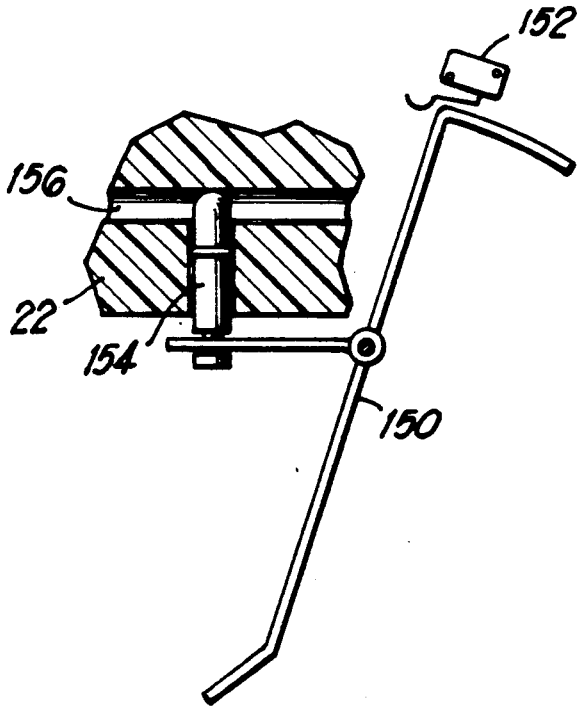
FIG. 12 is a partial, cross-sectional view of a dispensing valve showing a variable flow control feature thereof.

FIG. 12 shows a variable flow rate system that can be used on any of the above described embodiments. This system includes a cup lever arm 151 located below a dispensing valve 10 and adjacent to the nozzle 30 as is well-known in the art for actuating a dispensing valve to dispense the beverage into a cup.

According to the invention shown in FIG. 12, movement of the cup lever arm 151 immediately energizes a switch 152 to actuate the dispensing valve. This switch remains closed as long as the arm 151 is depressed. The cup lever arm 151 is also connected to a flow control 154 (through an arm 153) in the soda passageway 156 to the nozzle 30. If a high flow rate is desired, the cup lever arm 151 is pushed all the way back, whereby the flow control 154 provides a completely open passageway 156. The cup lever arm 151 is spring biased to its closed position shown in FIG. 12 and can be moved varying amounts to the right (as viewed in FIG. 12) to dispense beverage into a cup and to open the soda passageway 156 in varying amounts. As the cup approaches being filled, the cup lever arm 151 is allowed to move toward its closed position whereby the flow control 154 moves into the passageway 156 to slow down the flow. By means of the volumetric ratio control device of the present invention, even though only one of the soda and/or syrup passageways to the nozzle is varied, the ratio remains constant, because when the piston slows down, it slows down the pumping of both the soda and the syrup and at the correct ratio.

Figure 13:
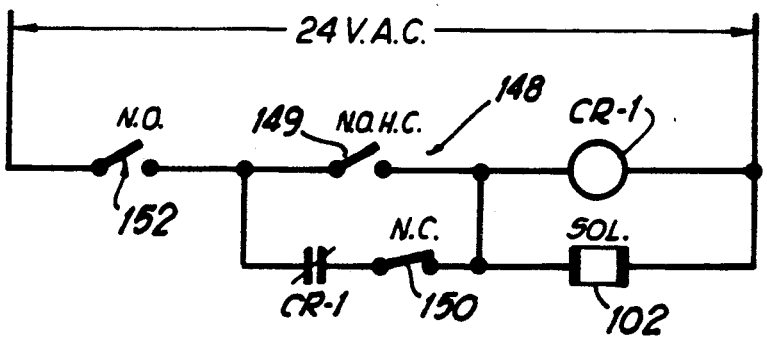
FIG. 13 is an electrical schematic of a circuit useful with the volumetric ratio control device of the present invention.

FIG. 13 shows a standard electrical circuit, including a holding circuit, for causing the soda and syrup pistons to reciprocate when the dispensing valve including the VRCD is energized. FIG. 13 shows the switches 152, 149 and 150, the solenoid 102 and relay CR-1. The operation of this standard circuit is well known and need not be described in any further detail herein.

FIG. 14 shows an overall arrangement of a beverage dispenser 12 with one or more dispensing valves 10 according to any one of the embodiments of the present invention. The beverage dispenser 12 can be provided with a syrup supply from any one of a known type of syrup containers such as a figal 14, a bag-in-box 16, or a gravity tank 18. In addition, according to the present invention, a syrup supply can also be provided in a non-returnable container 20 such as a plastic bottle. The container can be vented to atmosphere or preferably it can be a container that is capable of being safely pressurized to no higher than about 10 psig. The container 20 can be similar to the present two-liter PET bottles used for premix. The container 20 includes a lid 170 having a dip tube 172 extending down toward the bottom of the container 20 and a coupling for connection to the syrup line 21. The lid 170 also includes a one-way valve and fitting 174 for use in pressurizing the container 20 to its low pressure. It is noted that the pressure to which container 20 can be pressurized is much less than that to which a stainless steel figal 20 can be pressurized. According to the present invention, the means for delivering the syrup to the dispensing valve is the suction created by the volumetric ratio control device; however, it can be useful to have a small pressure in the container 20, if desired. However, the low pressure that is preferred to be used in the container 20 does not require the container to withstand any substantial pressures, whereby the container 20 can be made relatively inexpensively; that is, it can have relatively thin walls and a relatively inexpensive lid 170 that can be screw-threaded (or otherwise connected) onto the container 20 with a suitable O-ring or other seal structure.

The container 14, 16 and 20 are connected in the usual, known manner to the beverage dispenser 12; this is what is intended by the arrows on the ends of the syrup conduits. The dispenser 12 may or may not include a gravity tank 18.

FIGS. 15–24 show a dispensing valve 210 according to another and presently preferred embodiment of the present invention.

The valve 210 is similar in many respects to the valve 10 described above. The main differences are that valve 210 uses a diaphragm 212 and 213 associated with each syrup piston 214 and 251, uses a pair of flow through solenoid valves 216 and 217 in the soda circuit, and check valves 250–253 and a pressure regulator 254 in the syrup circuit.

The valve 210 can be mounted on the dispenser 12 as shown for valves 10 in FIG. 14.

As shown in FIGS. 15–24, the valve 210 includes a valve body 220 having a water (or soda) circuit or passageway 222 therethrough and a separate syrup or concentrate passageway 224 therethrough. The valve 210 has a size of less than about 90 cubic inches. The valve 210 has a nozzle 226.

The valve 210 has a self-contained VRCD 228 located entirely inside of the body 220 for controlling ratio and including water and concentrate passages 230 and 232 therethrough in communication with the water and concentrate passageways 222 and 224, respectively. The water passageway extend from a water inlet through the VRCD and then to the nozzle. The concentrate (syrup) extends from a concentrate inlet through the VRCD to the nozzle.

The VRCD 228 includes a single reciprocatable water piston 234 located in a pair of water chambers 236 and 237 and a pair of syrup pistons 214 and 215 located in a pair of syrup chambers 240 and 241, respectively. On the opposite side of each syrup piston from the syrup chambers 240 and 241 is an air chamber 242 and 243, respectively, vented to atmosphere. The soda piston is operated, as described above with reference to the previous embodiments, by the pressure of the water such that the operation of the device causes a predetermined ratio of water to syrup (or other concentrate) to be forced therefrom and also causes syrup to be drawn thereto; the VRCD operates through a plurality of reciprocating cycles for each dispensing operation.

The water passageway 222 is in communication with each of the water chambers 236 and 237, and the syrup passageway 224 is in communication with each of the syrup chambers 240 and 241.

Figure 16A:
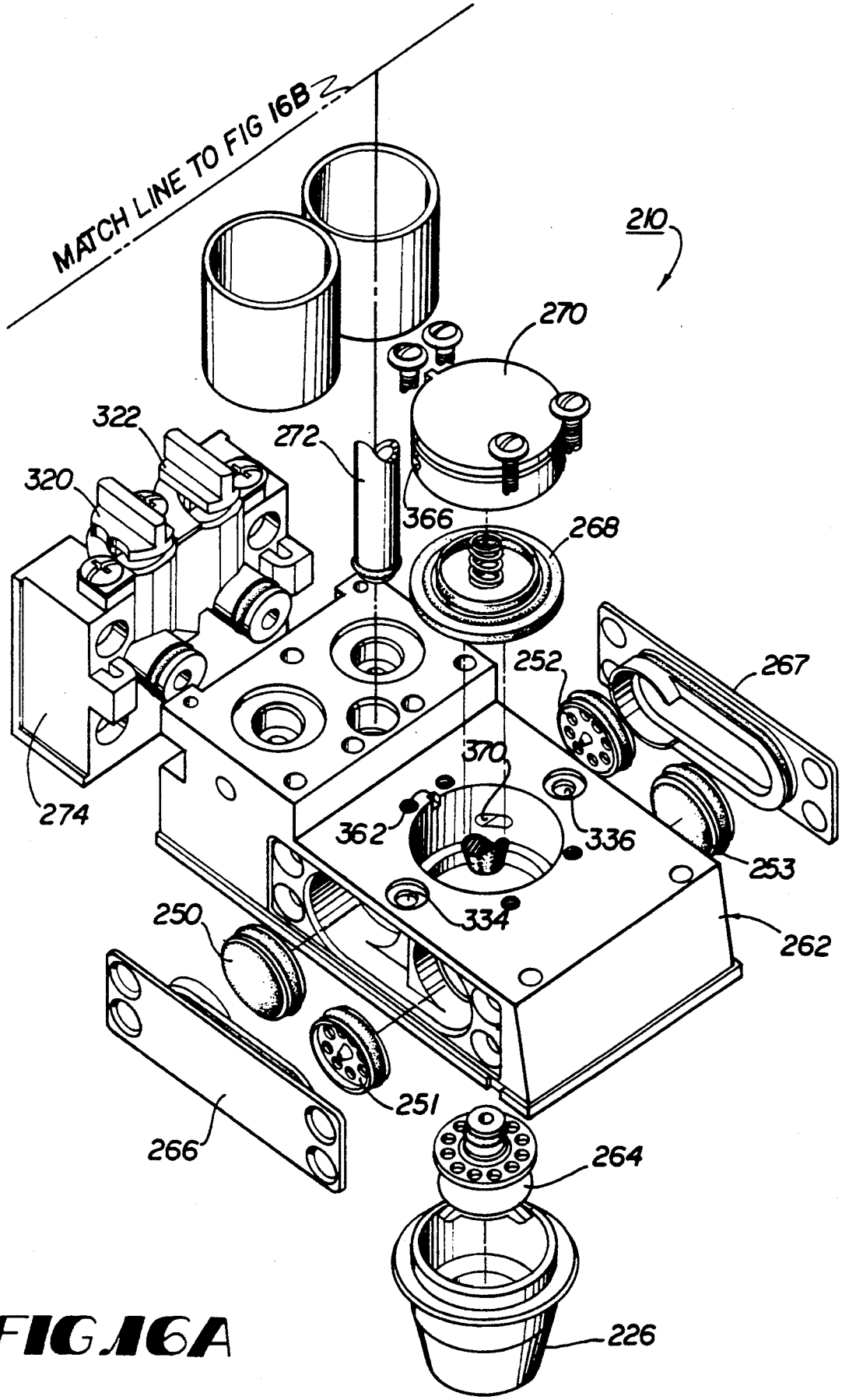
FIGS. 16A and 16B are isometric, exploded views of the valve of FIG. 15.
Figure 16B:
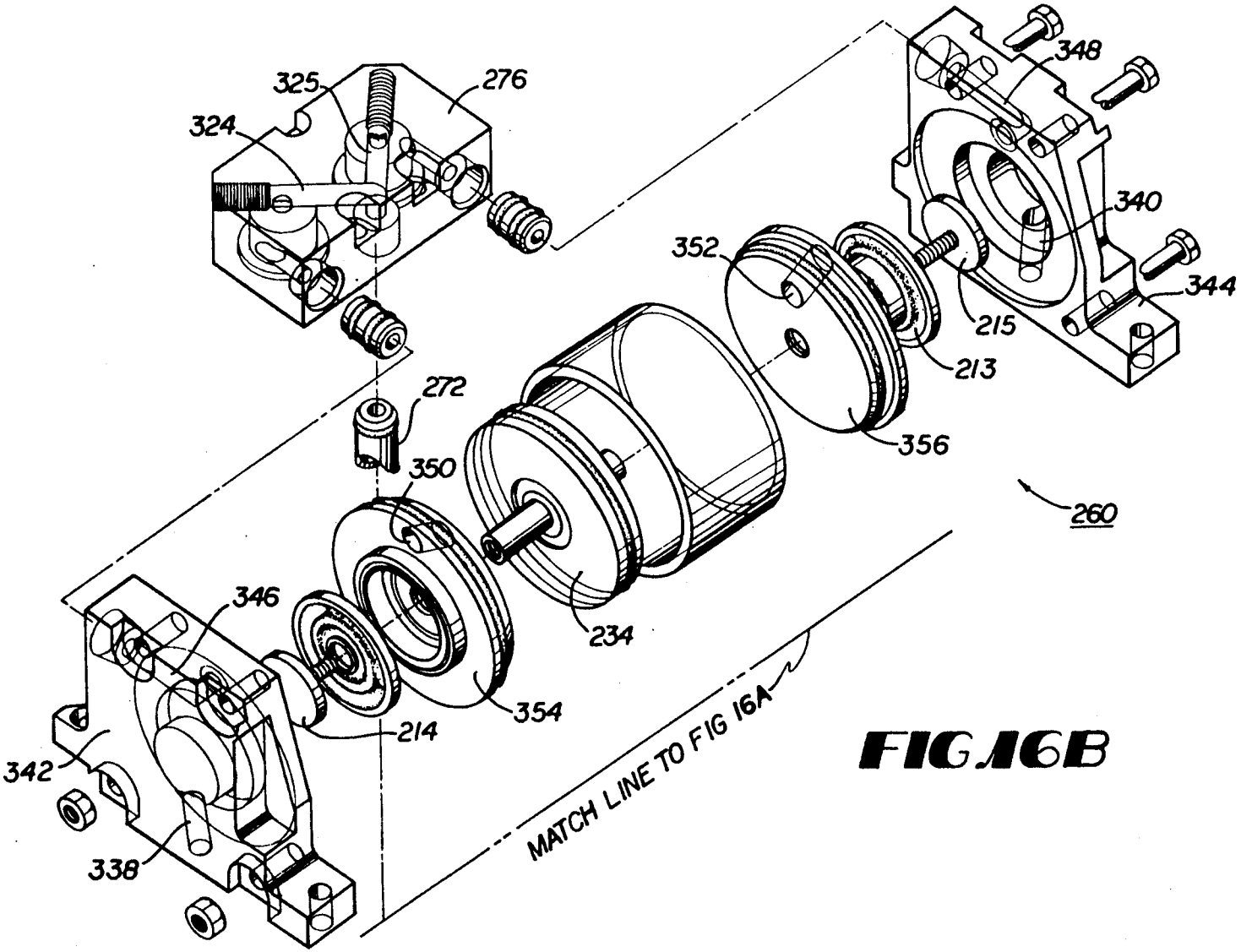
Figure 17:
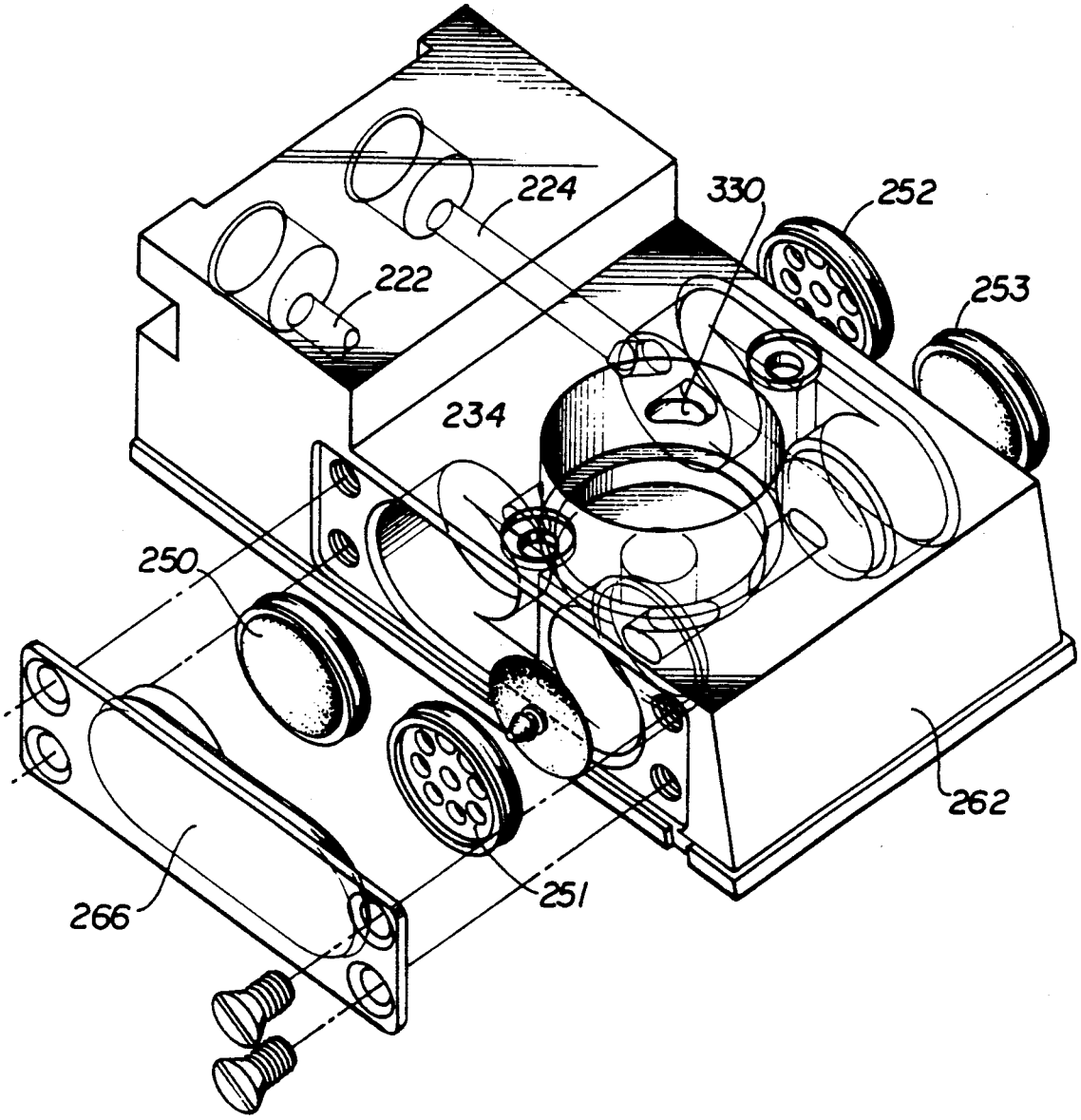
FIG. 17 is an enlarged, partial, exploded view of the valve body of FIG. 15.

The self-contained, direct acting electrical solenoid valves 216 and 217 are located entirely within the valve 210 for controlling the flow of water through the valve 210. The syrup flow is controlled by the check valves 250, 251, 252, and 253 and the pressure regulator 254. Referring now to FIGS. 16A and 16B, the valve 210 includes the valve body 220, a volumetric chamber body 260, a dispensing body 262, the nozzle 226, a diffuser 264, four check valves 250–253, two check valve covers 266 and 267, a syrup regulator diaphragm 268, a diaphragm cap 270, a connector tube 272, the two soda circuit solenoid valves 216 and 217, a mounting block 274, and a solenoid top plate 276. A valve cover 91 will be placed over the body 220 in the usual fashion.

The water piston 234 is caused to reciprocate by the water pressure as controlled by the solenoid valves 216, 217. The reciprocation of the water piston also causes the syrup pistons 214 and 215 to reciprocate, forcing syrup through the pressure regulator 254 and the check valves 251 and 253 to the nozzle 226. The syrup pressure and the spring 284 maintain valve 286 closed until the pistons move and force valve 286 open.

Figure 23:
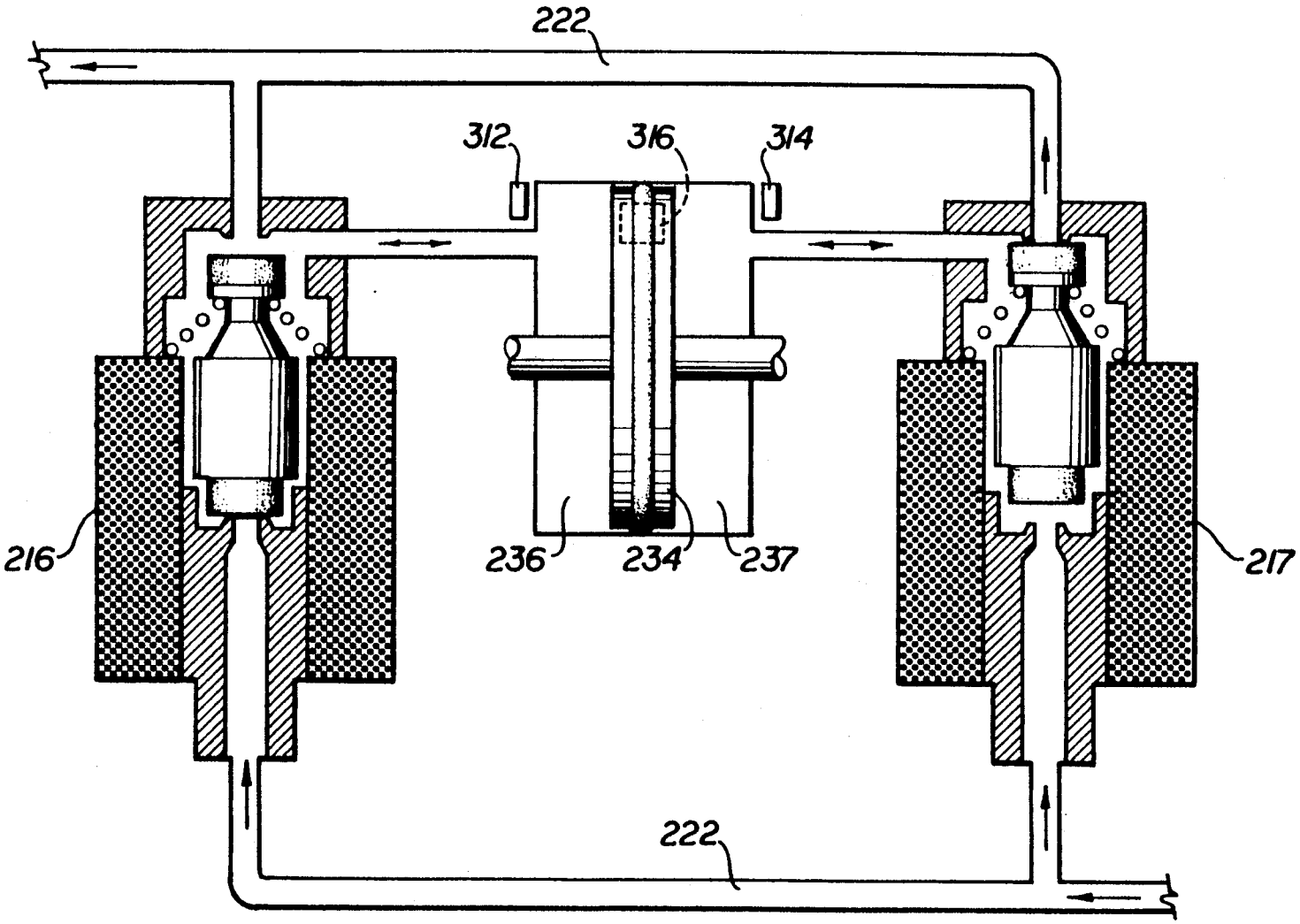
FIG. 23 is a partial, partly schematic, partly diagrammatic view showing the soda circuit.
Figure 24:
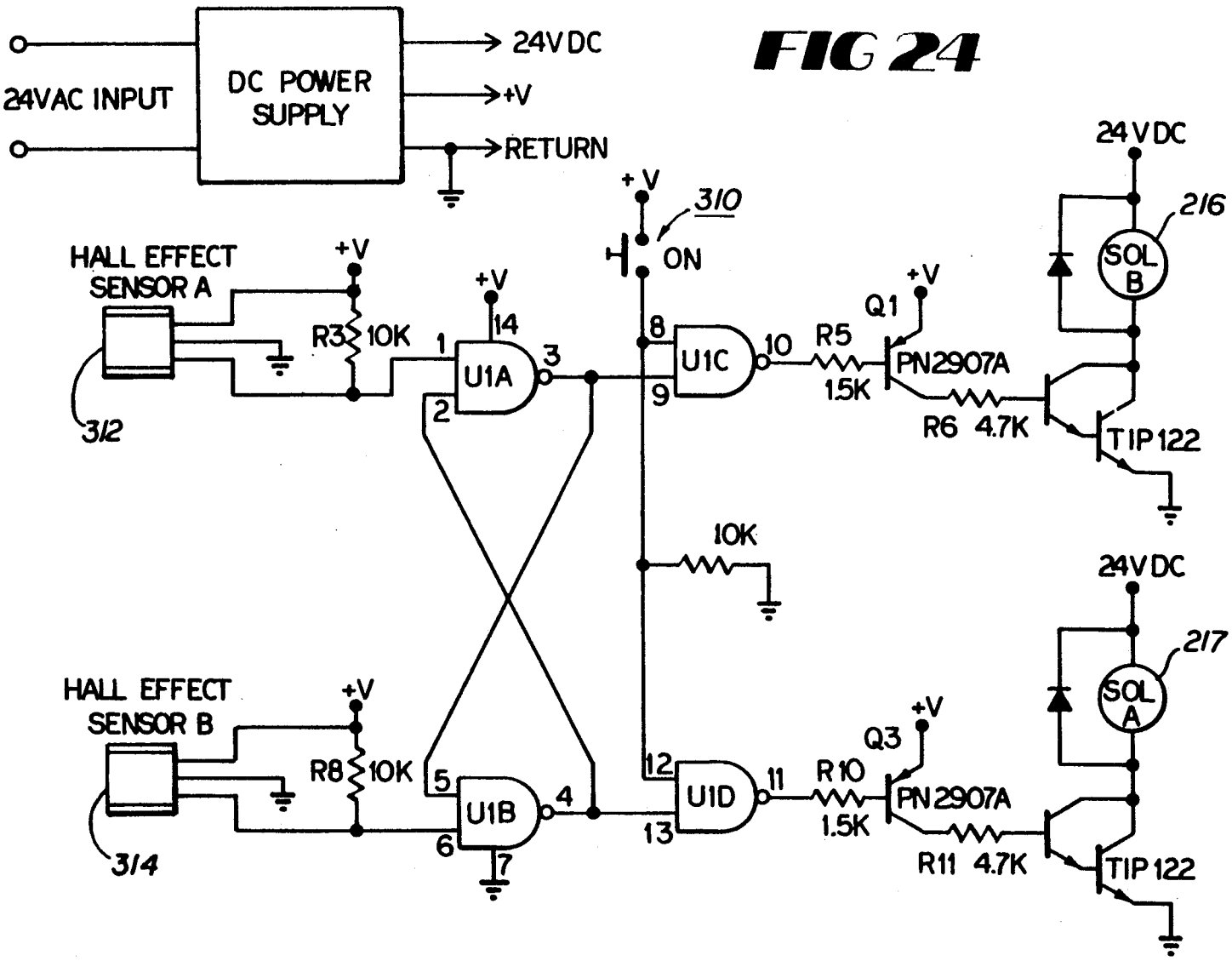
FIG. 24 is an electrical schematic.

FIG. 24 is an electrical schematic showing the operation of the valve 210 when a push button 310 is pushed to dispense a drink. The button 310 is preferably on the front of the cover 91. FIG. 24 shows the operation of the two hall effect sensors 312 and 314, the two solenoids 216 and 217 and the push button 310. FIG. 23 shows the sensors 312 and 314 and a magnet 316 located on the soda piston 234. When the button 310 is pushed, a circuit board is energized which decides which solenoid to energize which, then starts the dispense operation, with the sensors 312 and 314 controlling the reciprocating movement of the pistons.

Figure 15:
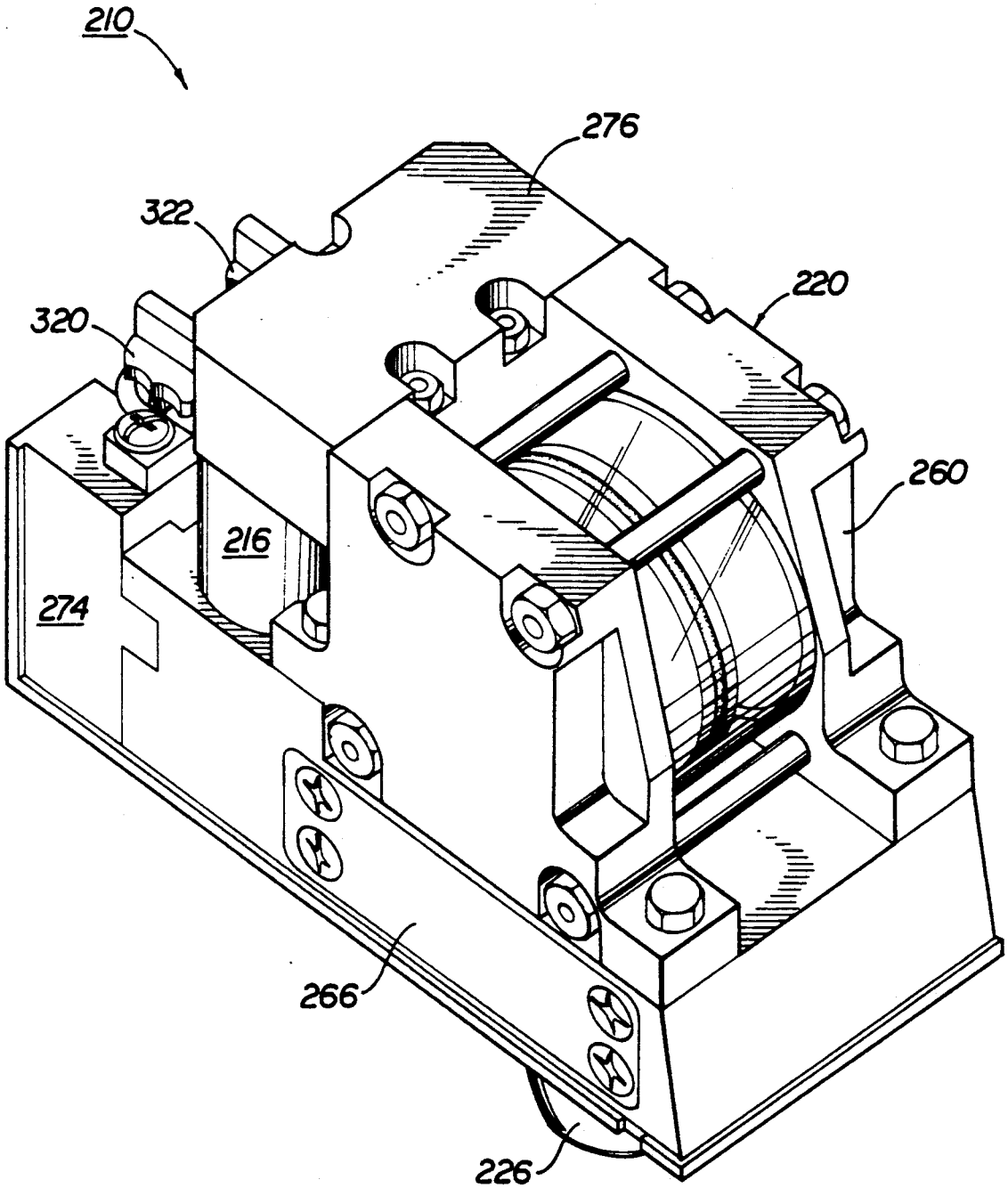
FIG. 15 is an isometric view of a dispensing valve according to the presently preferred embodiment of this invention.
Figure 22:
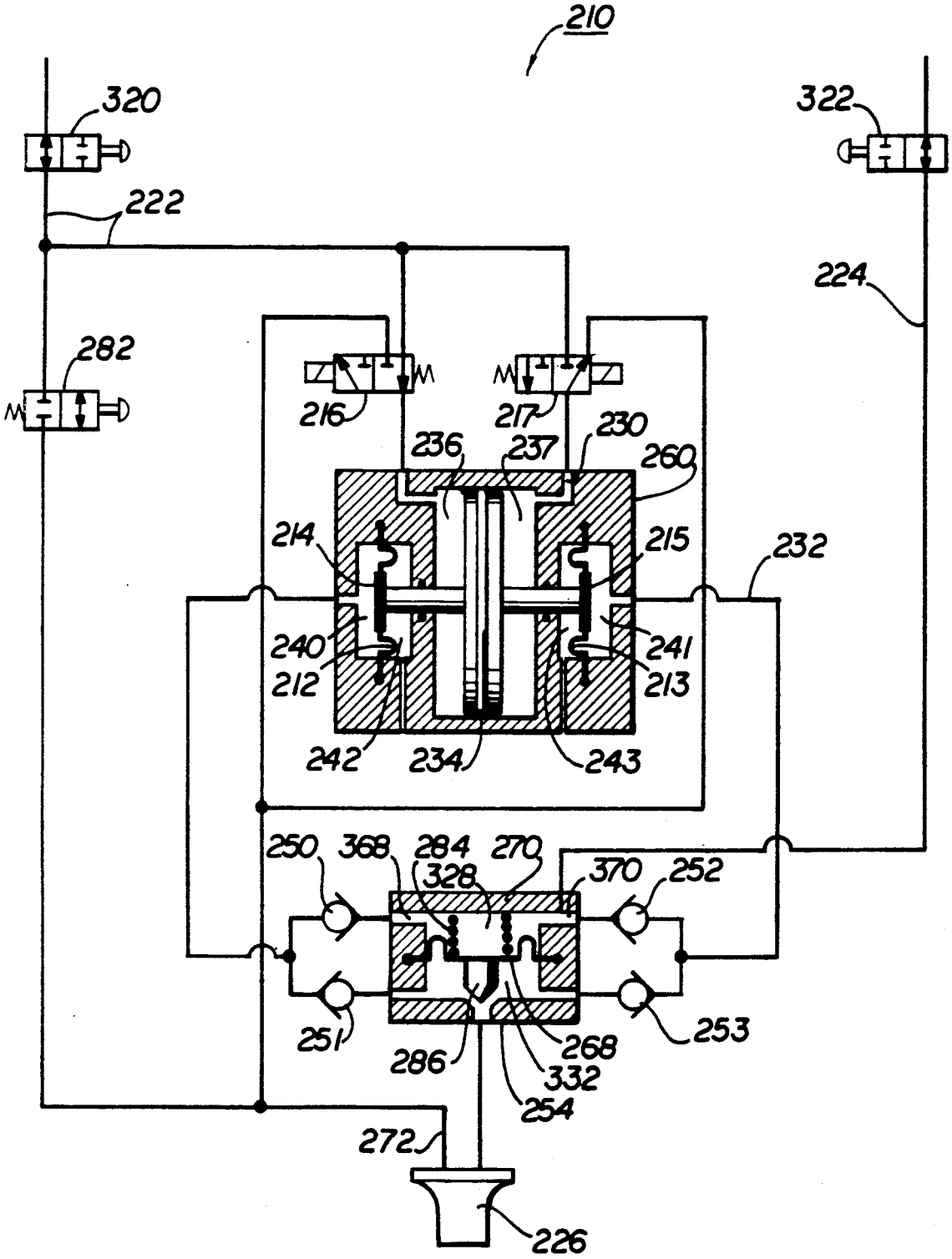
FIG. 22 is a partly schematic, partly diagrammatic view showing the operation of the valve of FIG. 15.

Referring to the drawings, it may be helpful to follow the flow path of both the soda and the syrup. The soda inlet is on the left as one faces the dispenser and the syrup is on the right. FIG. 22 shows the manual on-off valves 320 and 322 in the soda and syrup lines, respectfully. These valves are also shown in FIGS. 15 and 16A.

The soda comes in line 222, through the manual valve 320, to the bottom of the solenoids 216 and 217 (FIG. 23). Both solenoid valves are normally closed. When the push button 310 is pushed, one solenoid is energized, starting the dispense operation. Soda goes alternately through one of the solenoids to one of the soda chambers 236, 237 and alternately from the other soda chamber through a solenoid out one of the top soda passages 324, 325, to and down the connector tube 272 and then through passage 326 and out opening 300 to the nozzle at a point below the syrup pressure regulator and above the diffuser. Referring to FIG. 16B, the soda flows to and from the soda chambers 236 and 237 through passages 346 and 348 in end blocks 342 and 344, respectively, and then through passages 350 and 352 in discs 354 and 356, respectively.

The syrup comes in line 224 (FIG. 17) into the top chamber 328 of the pressure regulator via opening 330 (FIG. 17) and also through check valves 250 and 252 into syrup chambers 240 and 241. When a drink is requested and the syrup pistons 214 and 215 reciprocate, syrup then flows alternately from the syrup chambers through the check valves 251 and 253 into the bottom chamber 332 of the pressure regulator 254, causing the valve 286 to open, and then to the nozzle 226. When the syrup flows through the check valves 250 and 251, it then flows up (in FIG. 17) through the openings 334 and 336 and then through passages 338 and 340 (see FIG. 16B) in end blocks 342 and 344, and into the syrup chambers 240 and 241.

Figure 18:
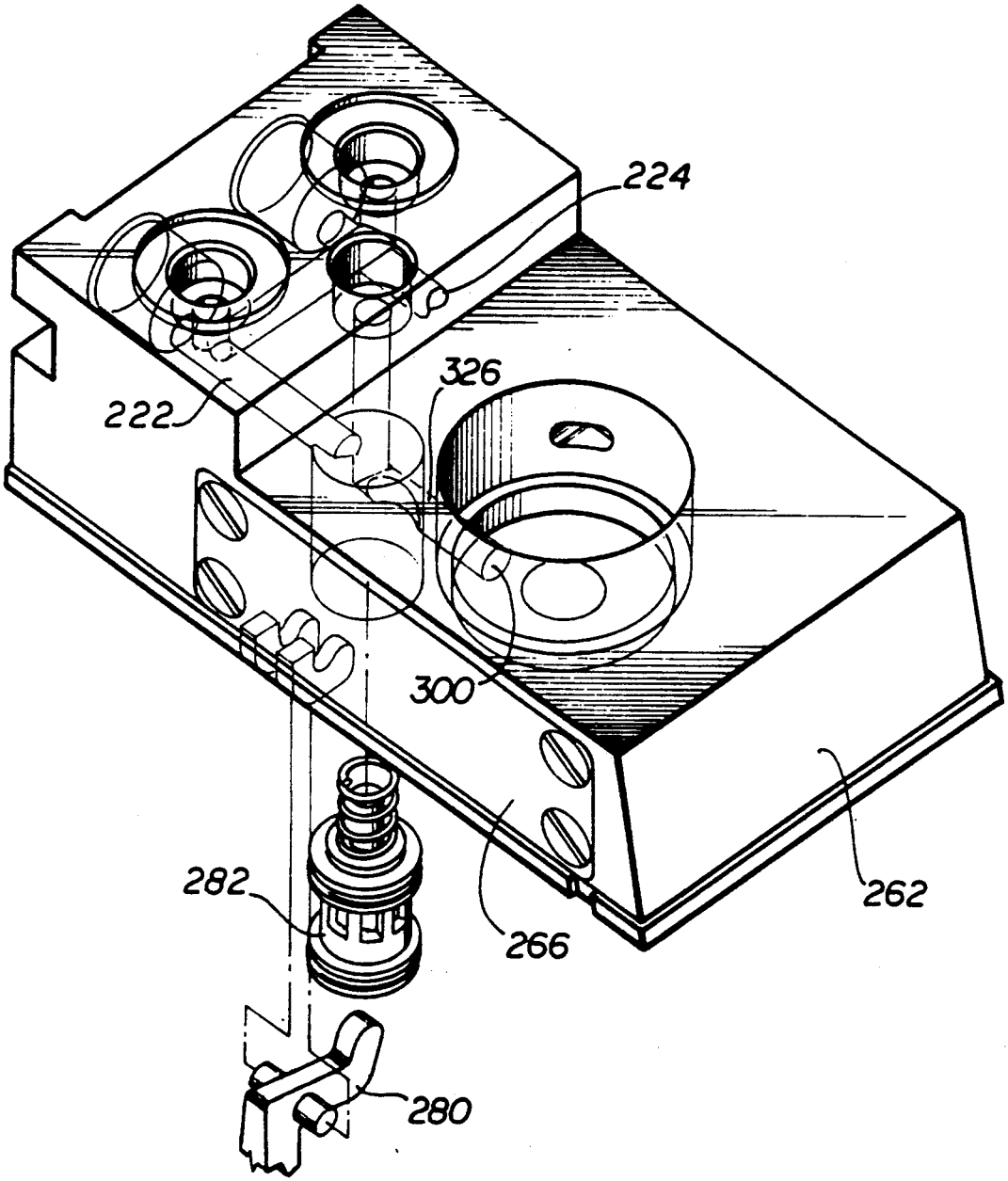
FIG. 18 is another enlarged, partial, exploded view of the valve body of FIG. 15.
Figure 19:
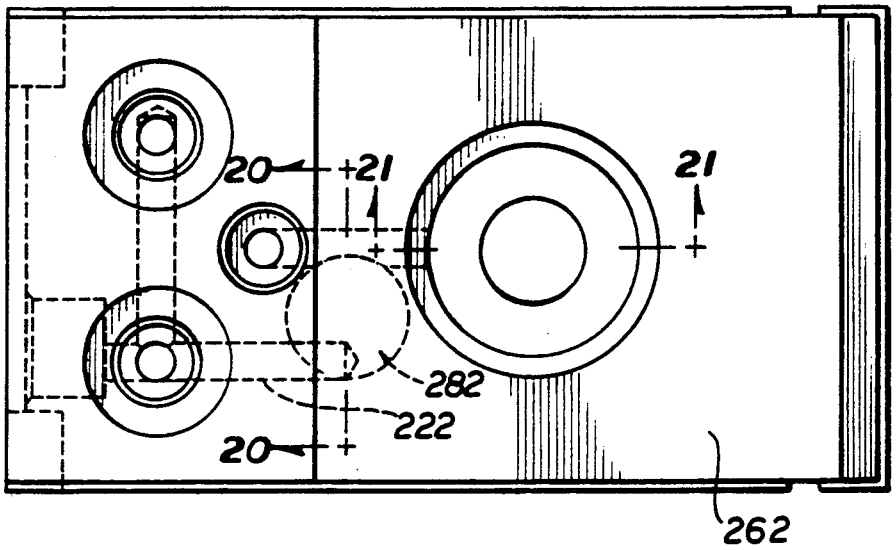
FIG. 19 is a partial, top plan view of the valve body of FIG. 15.
Figure 20:
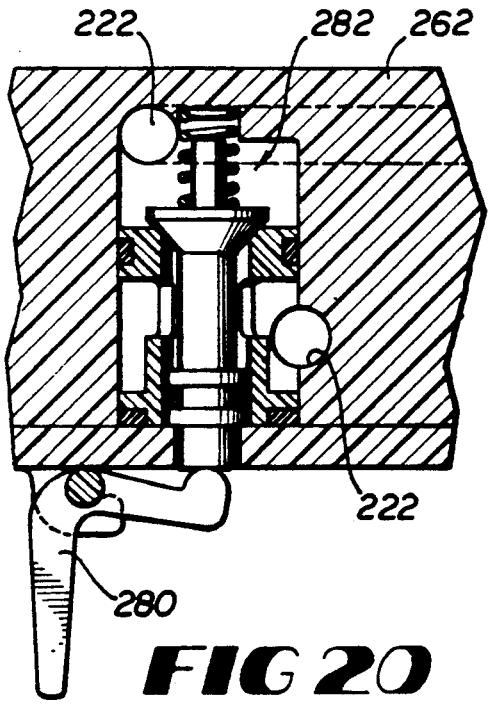
FIG. 20 is a cross-sectional view taken along line 20—20 in FIG. 19.
Figure 21:
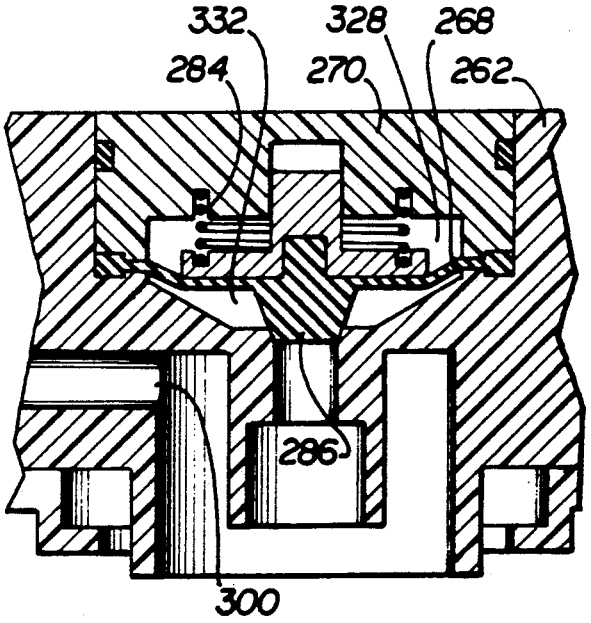
FIG. 21 is a cross-sectional view taken along line 21—21 in FIG. 19.

FIGS. 18, 20 and 22 show a feature of this invention that allows an operator to just dispense soda water, if desired, by pushing a lever arm 280. The arm 280 is pivoted and when pushed causes a valve 282 to open. When pressure is removed from the lever arm 280, a spring 360 closes the valve 282. Of course, the manual valve 320 (FIG. 22) has to be open to dispense soda water.

FIG. 16A shows a notch 362 and a tab 364 on diaphragm cap 270 to properly orient the cap so the syrup opening 366 will be in registry with a syrup opening 368 (FIG. 22) in the pressure regulator 254. The cap 270 includes a skirt that extends down to lock the diaphragm 268 in place. The opening 368, not shown in FIG. 16A, corresponds to opening 370 shown in FIGS. 16A and 22.

The two solenoids 216 and 217 are three-way solenoids. The diaphragms 212 and 213 used with the syrup pistons have the advantage of not leaking, as compared to pistons alone. The valve 210 can alternatively use a cup lever arm or portion control, in place of, or with the push button 310.

It is noted that the present day post-mix dispensing valves have a maximum volume of less than about 90 cubic inches, that is, having maximum dimensions of, for example, about 3"×5"×6" for the housing or body portion of the post-mix dispensing valve, not including the nozzle or spout that extends down below the dispensing valve. Thus, the self-contained VRCD and valve control means of the present invention are contained within a post-mix dispensing valve having a volume or size no greater than about 90 cubic inches. The maximum size for the total of both of the concentrate chamber and the water chamber is 2.0 fluid ounces with the preferred total volume being about 0.7 fluid ounces. This total volume is divided between the soda chamber and the syrup chamber in the desired ratio, such as, for example, 5:1. In a preferred configuration of the post-mix dispensing valve of this invention the VRCD goes through approximately nine complete cycles for a 12-ounce drink. The term "multicycle" is hereby defined to mean that the piston moves back and forth more than once for each cup of beverage dispensed. It is noted that in the preferred embodiment the post-mix dispensing valve of this invention includes a maximum of approximately one ounce of total soda and syrup residual in the dispensing valve itself. It is an important aspect of this invention to minimize the casual drink problem. It is noted that each of the soda and syrup control means of this invention can use one four-way valve, two three-way valves or four two-way valves.

While the preferred embodiments of this invention have been described above in detail, it is to be understood that variations and modifications can be made therein without departing from the spirit and scope of the present invention as set forth in the appended claims. While the preferred non-returnable container 20 is a rigid plastic bottle, a collapsible container such as a plastic bag similar to that used in the present bag-in-box containers 16 can also be used. The non-returnable container 20 can alternatively be vented to atmosphere and not be under any additional pressure. While the preferred water and concentrate are carbonated water and syrup, respectfully, this invention can also be used with plain water and with fruit juice concentrates, tea and coffee, for example. While the solenoids are preferably pull solenoids, push solenoids can also be used.

I claim:

1. A beverage dispensing valve for dispensing a beverage into a cup and adapted to be mounted on a post-mix beverage dispenser comprising:

(a) a post-mix beverage dispensing valve including a body having a water passageway therethrough and a separate concentrate passageway therethrough, said body have a size of less than about 90 cubic inches;

(b) said dispensing valve including a nozzle connected to said body for simultaneously dispensing water and concentrate from said dispensing valve;

(c) a self-contained volumetric ratio control device located entirely inside of said body of said dispensing valve for controlling the ratio of water to concentrate in the beverage dispensed from said nozzle, and including a water passage therethrough in communication with said water passageway and a separate concentrate passage therethrough in communication with said concentrate passageway;

(d) said water passageway extending from a water inlet passageway in said body through said volumetric ratio control device and then to said nozzle;

(e) said concentrate passageway extending from a concentrate inlet passageway in said body through said volumetric ratio control device and then to said nozzle;

(f) said volumetric ratio control device including a water piston reciprocatably mounted in and separating a chamber into a pair of water chambers, and a pair of concentrate pistons connected by a stem to opposite sides of said water piston, each concentrate piston being reciprocatably mounted in and separating a chamber into a concentrate chamber and an air chamber, each air chamber being vented to atmosphere, and each concentrate piston including a diaphragm sealing the concentrate chamber from the air chamber, said piston being operated by the pressure of the water such that operation of said device causes a predetermined ratio of water to concentrate to be forced therefrom and also causes concentrate to be drawn thereto and said device operating through a plurality of reciprocating cycles for each dispensing operation;

(g) said water passageway being in communication with each of said water chambers;

(h) said concentrate passageway being in communication with each of said concentrate chambers;

(i) water flow control means including a pair of self-contained, direct acting, three-way electrical solenoid valve means located entirely inside of said body of said dispensing valve and in said water passageway for controlling the flow of water through said volumetric ratio control device and for controlling the reciprocating movement of said pistons in response to the pressure of the water in said water passageway; and (j) concentrate flow control means located in said concentrate passageway and including four check valves and a pressure regulator.

2. The valve as recited in claim 1 wherein said water is carbonated water and said concentrate is syrup.

3. The valve as recited in claim 1 wherein said total volume of the water and concentrate chambers is less than about 0.7 fluid ounces.

4. The valve as recited in claim 1 wherein said pressure regulator includes a diaphragm separating a chamber into inlet and outlet chambers and with two of said check valves communicating with said inlet chamber and two with said outlet chamber and with a valve member connected to said diaphragm in said outlet chamber and a spring in said inlet chamber biasing said valve member closed.

* * * * *